United States Patent [19]

Jump

[11] Patent Number: 4,723,373

[45] Date of Patent: Feb. 9, 1988

[54] JAIL CELL SECURITY SYSTEMS

[75] Inventor: Ralph F. Jump, Independence, Ky.

[73] Assignee: Stewart-Decatur Security Systems, Inc., Erlanger, Ky.

[21] Appl. No.: 923,676

[22] Filed: Oct. 27, 1986

[51] Int. Cl.[4] ..... E05B 47/00

[52] U.S. Cl. ..... 49/18; 49/20

[58] Field of Search ..... 49/8, 17, 16, 15, 19, 49/20

[56] References Cited

U.S. PATENT DOCUMENTS 3,837,117 9/1974 Butt ..... 49/18

3,913,263 10/1975 Butt ..... 49/18

4,641,458 2/1987 Pilcher et al. ..... 49/18 X

*Primary Examiner*—Philip C. Kannan

*Attorney, Agent, or Firm*—Kinney & Schenk

[57] ABSTRACT

A security system for a jail cell block is described. The individual cells are each provided by drop bar means which are shiftable between a position in which the cell door is locked and a position in which the door is released for opening movement. Deadlock means are provided to prevent movement of the drop bar means to the release position. A master control has a "Deadlock", a "Release" and an "Individual Cell" mode. In the "Deadlock" mode, additional means are provided to prevent movement of the drop bar means, of all cells, out of their locking positions. In the "Release" mode, the deadlock means of all cells are disabled and the drop bar means are displaced to their release positions. In the "Individual Cell" mode movement of the drop bar means, of all cells, is restrained only by the deadlock means and either key option means or remote switch means can be employed to selectively disable the deadlock means and shift the drop bar means of that cell to a release position, to permit opening of the cell door.

6 Claims, 15 Drawing Figures

INDIVIDUAL CELL
DEADLOCK
RELEASE 26
28
30
32
34
36
38
39
40
46
48
50
52
54
56
58
60
62
64
66
68
70
72
74
76
78
114
115
116
118
120
124
128
130
132
136
138
140
142
144
146
148
150
152
154
156
158
160
162
164
166
178
180
182
184
4
8

6
6

JAIL CELL SECURITY SYSTEMS

The present invention relates to improvements in security systems for jail cells and more particularly to improved means for permitting a selected cell, or cells, in a cell block, to be opened while the remaining cells remain locked.

An effective jail cell security system is disclosed in U.S. Pat. No. 3,837,117. In that system, means are described for locking each individual cell, of a cell block. Those means comprise a drop bar and an extension thereto, which, in a lower position lock the cell door against opening movement. Deadlock means are provided to prevent the drop bar and extension from being raised from this locking position.

A master control has four operative modes, which are effective, through a master control bar. (A) to secure all cells in the block, (B) to release the locking means for all of the cells, (C) to permit the locking means for any selected cell to be released through a key controlled linkage, or (D) to permit the locking means for any selected cell to be released by actuation of a remote electrical switch.

The object of the present invention is to simplify and provide greater operational flexibility for the referenced security system.

These ends are broadly attained by a jail cell security system in which each cell has a drop bar and drop bar extension which lock the cell door against opening movement, with deadlock means preventing displacement of these drop bar means from their locking positions.

A simplified master control, again effective through a master control bar which extends to all of the cells in the cell block, is provided. This master control has three operative modes. One of which is a "Deadlock" mode in which cams on the master control bar are positioned to provide additional means to prevent all of the drop bar means from being displaced from their locking positions. A "Release" mode of the master control positions cams on the master control bar, to positively displace the drop bar means, for all of the cell doors, from their locking position, thereby releasing all doors for opening movement.

The master control has a third, "Individual Cell" mode in which the drop bar means, for any selected cell, may be displaced from its locking position by either a key option or a remote switch option.

The key option comprises a key controlled plunger, adjacent each cell, which displaces linkage means for first disabling the deadlock means and then displacing the drop bar means from its locking position, thereby permitting the selected, individual cell to be opened.

The remote electrical switch option comprises an electric motor and an electrical circuit for its energization. This circuit is rendered operative by a sensing switch which is closed in the "Individual Cell" mode of the master control. Closure of a remote switch energizes the motor for 180 deg. of rotation of a cam. This cam is provided with means for disabling the deadlock means, and a lobe on the cam then displaces the drop bar means from its locking position, to permit the selected cell door to be opened.

The above and other related objects and features will be apparent from a reading of the following description of a preferred embodiment and the novelty thereof pointed out in the appended claims..

Figures 1, 2:
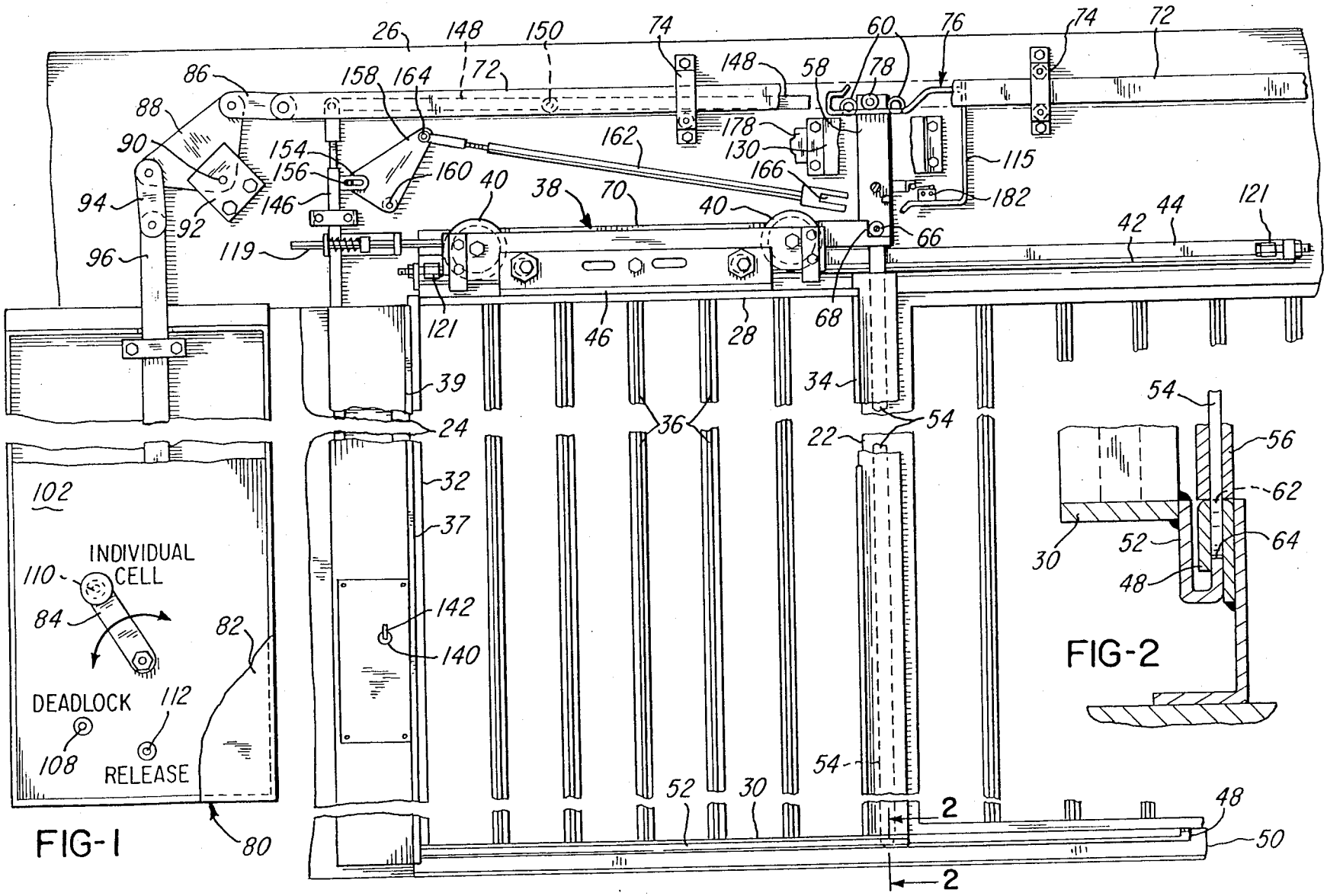
FIG. 1 is an elevation of a jail cell door and locking mechanism, embodying the present invention, for controlling sliding movement of the door, with portions broken away and in section.
FIG. 2 is a section, taken on line 2—2 in FIG. 1, on an enlarged scale.

Reference is first made to FIG. 1 for a description of the jail cell environment of the present invention. A jail cell door 20 is shown in its position blocking ingress and egress through the cell entry which is defined by the spaced, vertical surfaces of walls 22, 24 (these walls could also be formed by spaced bars). The upper limit of the opening is defined by an elongated, metal transom, or plate 26.

The door is slidable to the right to open this entry for ingress or egress. The security system of the present invention locks the door in its illustrated, closed position when the cell is to be secured. The control means selectively permits the door 20 to be opened, as circumstances may require, concurrently all the doors of a plurality of cells in a cell block, or independently, either by a key or by a remotely actuated switch, all as will be described hereinafter.

The door 20 comprises a rectangular frame consisting of top and bottom rails 28, 30 and vertical bars 32, 34 and a plurality of spaced, vertical bars 36, all welded together to form a rigid assembly. In the closed position of the door, the left hand bar 32 engages a strike plate 37, which is secured to one side of a compositely formed pilaster 39. The pilaster 39 is rigidly attached to the front face of the cell wall 24.

Sliding movement of the door 20 is provided by a trolley assembly 38 (see also FIG. 8) comprising a pair of grooved wheels 40. The wheels 40 ride on a rail 42 in the horizontal leg of an angle bar 44 which is secured to the transom 26. The trolley assembly 38 is secured to the door 20 by a z-bar 46 which is welded to the upper door rail 28. The lower end of the door 20 is constrained to the same horizontal movement by guide means which comprise a fixed, inverted U-shaped guide member 48 secured to the floor by an angle iron 50 (see also FIGS. 2 and 3). A similar, U-shaped guide member 52 is secured to the bottom rail 30, of the door 20. The short legs of these guide members are received in the channels they define, thus guiding the lower end of the door 20 for sliding movement, while preventing movement of the door inwardly or outwardly of this defined plane of movement.

A drop bar 54 is provided to lock the door in its closed position. The drop bar is slidably mounted in a post 56 which is secured to the wall 22 and extends from the transom 26 to the fixed guide 48. A drop bar extension 58 is secured to the upper end of the drop bar 54. Spaced rollers 60, mounted on the transom 26, guide the upper end of the extension 58 for vertical reciprocating movement.

Figures 3, 4:
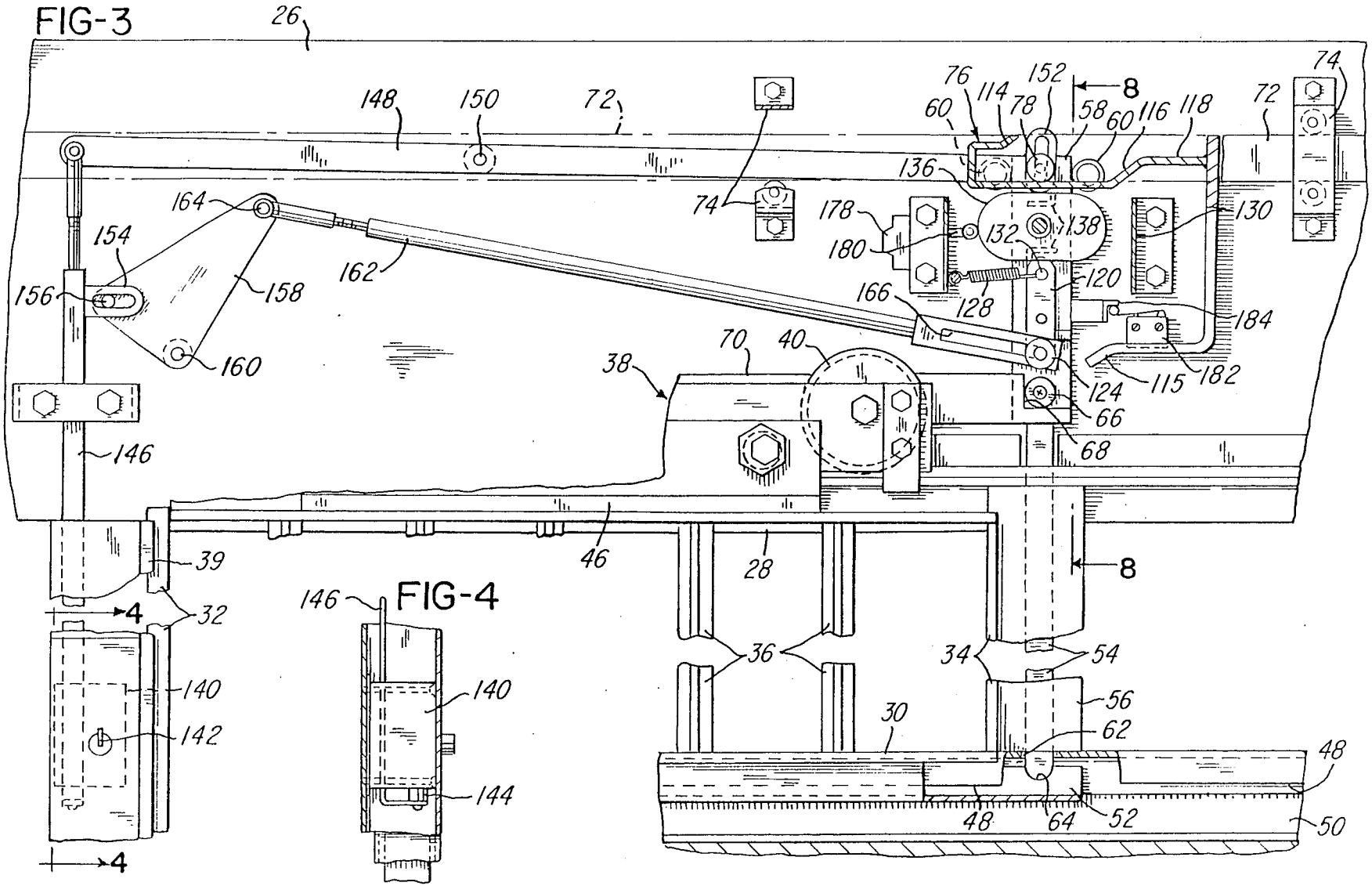
FIG. 3 is a view, on an enlarged scale, of control mechanism seen in FIG. 1, with further portions broken away and in section to illustrate control of a drop bar, which is raised to permit opening of the door.
FIG. 4 is a section taken on line 4—4 in FIG. 3.

In the lower, locking position, of the drop bar 54, its lower end extends through an opening 62 in the bridge of the fixed guide member 48 and projects into an aligned notch 64 in the door guide member 52 (FIGS. 2 and 3). Further locking action is provided at the upper end of the door 20 by a roller 66, which projects from the drop bar extension 58, see FIGS. 3 and 8. The roller 66 rests in a notch 68 formed in a travel rail 70, the latter being secured to the trolley 38. The vertical surface of the notch 68 engages the roller 66 to prevent movement of the trolley, and the door 20, toward the right and an open position.

Figures 5, 6:
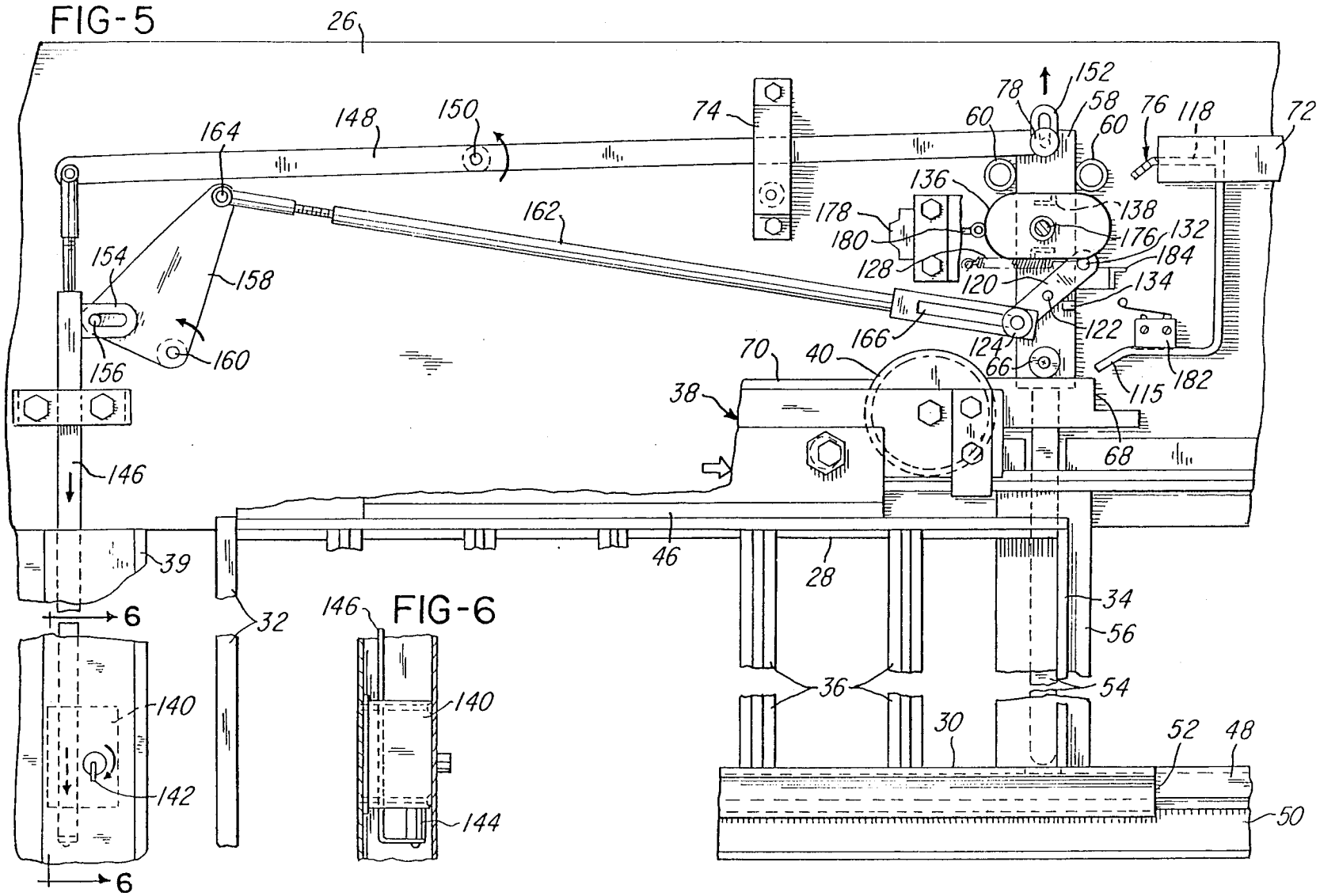
FIG. 5 is a view similar to FIG. 3, illustrating unlocking of the door in a "key" option.
FIG. 6 is a section taken on line 5—5 in FIG. 5.

It will be apparent that raising the drop bar 54 so that its lower end clears the notch 64 and the roller 66 clears the notch 68, permits the door 20 to be opened by sliding it toward the right, as illustrated in FIG. 5.

It is a normal practice for a series of cells to be arranged in a row, known as a block. The cell indicated in FIG. 1 represents the first in a plurality of cells extending toward the right in the drawing. Each of such cells would be provided with a door and locking mechanism identical with that described.

The control means include a master control bar 72 which is shifted horizontally to simultaneously place all of the cell doors in the same control mode. The master control bar 72 extends to the right of FIG. 1 through the full extent of the cell block. It is supported for sliding movement by a plurality of roller brackets 74, see FIGS. 10 and 11. A cam 76 is secured to the bar 72 in cooperative relation with a roller 78, which projects from the drop bar extension 58 (see also FIG. 8). Identical cams 76 are secured to the master control bar 72 in the same operative relation with rollers on the drop bar extensions of the remaining cell doors in the cell block.

Figure 14:
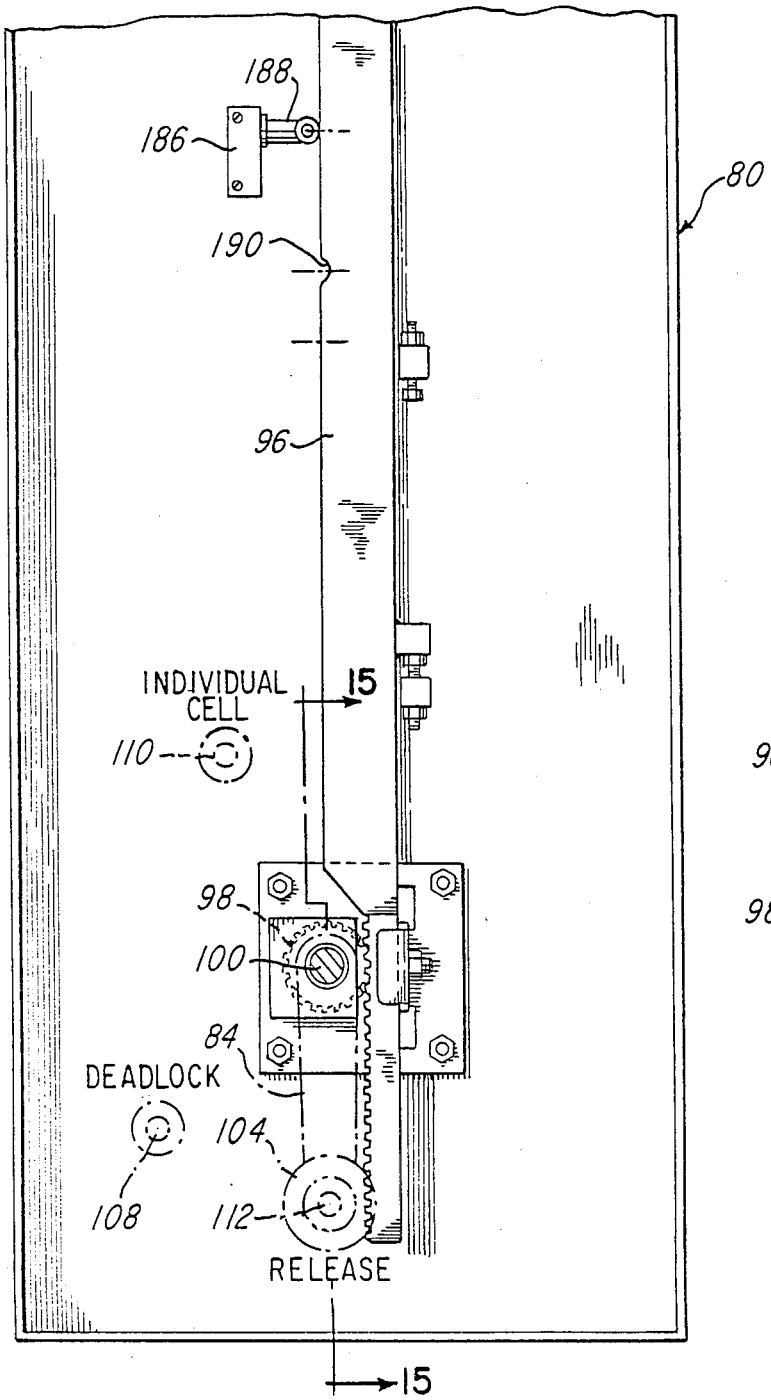
FIG. 14 is an elevation, on an enlarged scale, of a mode selector mechanism seen in FIG. 1, and taken on line 14—14 in FIG. 11.
Figure 15:
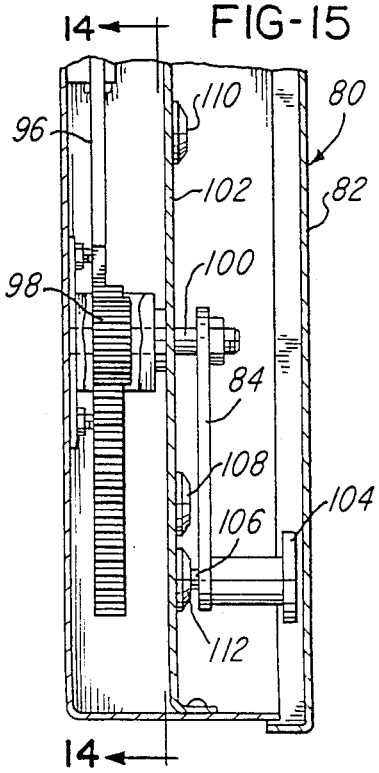
FIG. 15 is a section taken on line 15—15 in FIG. 14.

A master control 80, shown in FIGS. 1, 14 and 15, is provided for each cell block. It is conveniently mounted in a fixed position to the left of the pilaster 39. A cover panel 82 is removable to provide access to a control lever 84, see also FIGS. 10 and 11. Lever 84 has three operative positions in which, respectively, all doors in a cell block are opened, all doors are deadlocked to prevent opening, and a position in which the cell doors may be individually opened, either by operation of a key lock, or by actuation of a remote switch.

The lever 84 is operatively connected to the master control bar 72 through a linkage which comprises a link 86 connecting the left end of the bar 72 to a bell crank 88 which is pivotal about a pin 90 mounted in a bracket 92, which, in turn is secured to the transom 26. A link 94 connects the opposite leg of the bell crank 88 to a vertically reciprocable bar 96. A rack is formed in the lower end of the vertical bar 96, with which a pinion 98 meshes. The pinion 98 is secured to a shaft 100 which is journaled on and extends through an intermediate panel 102, within the master control housing. The lever 84 is secured to the shaft 100 and provided with a knob 104 at its outer end. The knob 104 is secured to a spring loaded pin 106 which selectively cooperates with detent buttons 108, 110 and 112, mounted on the intermediate panel 102. These detents, respectively, define "Deadlock", "Individual Cell" and "Release" modes of the master control. It is to be noted that in FIG. 1, the master control mechanism is illustrated in the "Individual Cell" mode, while in FIGS. 14 and 15 it is in the "Release" mode.

Figure 12:
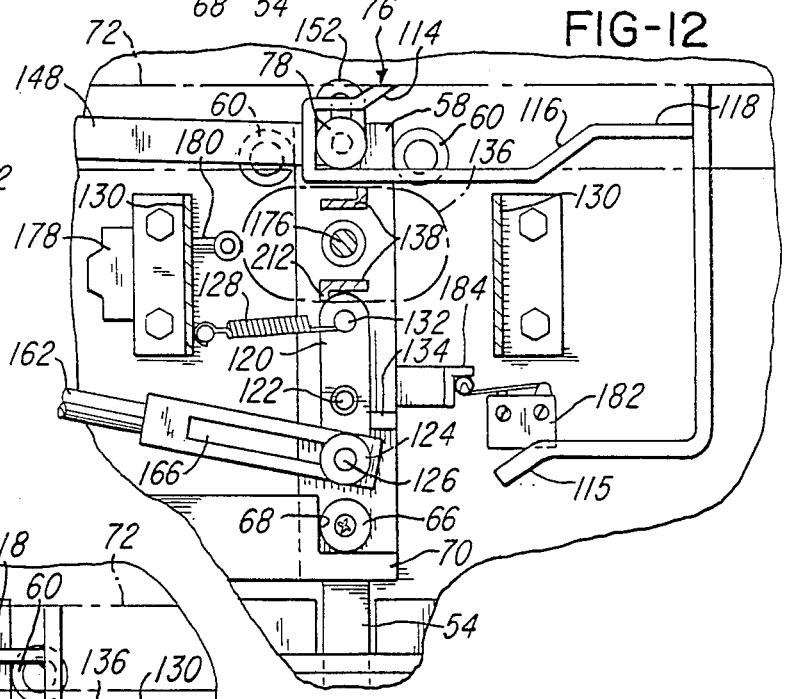
FIG. 12 is an elevation, on an enlarged scale, particularly illustrating mechanism for lifting the drop bar in the "key" option.

In the deadlock position of the lever 84, the bar 96 is raised to an upper position (from that shown in FIG. 1), displacing the master control bar 72 to the right to bring an upper leg 114 of the cam 76 into overlying relation with the roller 78, which projects from the drop bar extension 58, as shown in FIG. 12. The cam leg 114 is beveled to displace the roller 78 downwardly to assure that the drop bar 54 and extension 58 are displaced to their locking positions.

In the "Deadlock" mode of the master control 80, the cam leg positively prevents upward movement of the drop bar 54 and extension 58 from their locking positions in which the lower end of the drop bar engages the notch 64 (FIG. 3) and the roller 66 is engaged by the vertical face of notch 68, to prevent opening of the door 20. The remaining cell doors, with which the bar 72 cooperates, are similarly secured so that none of the doors of the cell block can be opened so long as the master control 80 remains in the "Deadlock" mode.

The term "deadlock" references a further means for locking the drop bar 54 and its extension 58 in their lower, locking positions. The deadlock is provided by a link 120 (FIGS. 8 and 12) which is pivoted, at its midpoint, on a pin 122 projecting outwardly from the drop bar extension 58. This link is normally maintained in a vertical position by a weighted roll 124, carried by a pin 126 projecting from its lower end. Additionally, a tension spring 128 is connected between a fixed bracket 130 and a pin 132 projecting from the upper end of the link 120. This spring resiliently urges the link 120 in a counter-clockwise direction, with a stop 134 positioning it in the vertical position.

A rotary cam 136 is mounted on the bracket 130 and spaced outwardly of the link 120. Cam 136 is a component of the referenced means for independently opening cell doors and will be later described in greater detail. For present purposes it is sufficient to understand that the cam 136 provides a relatively fixed structure from which tabs 138 project inwardly to vertically overly the upper end of the link 120. In each cycle of its operation, the cam 136 rotates 180 deg. so that one or the other of the tabs 138 will be closely spaced above the upper end of the link 120.

It will thus be seen that upward movement of the drop bar extension 58 is prevented by engagement of the upper end of link 120 with the fixed stop provided by one or the other of the tabs 138. The link, in this vertical position is commonly referenced as being deadlocked and provides a means for preventing upward movement of the drop bar and drop bar extension, independently of the cam leg 114.

Figure 13:
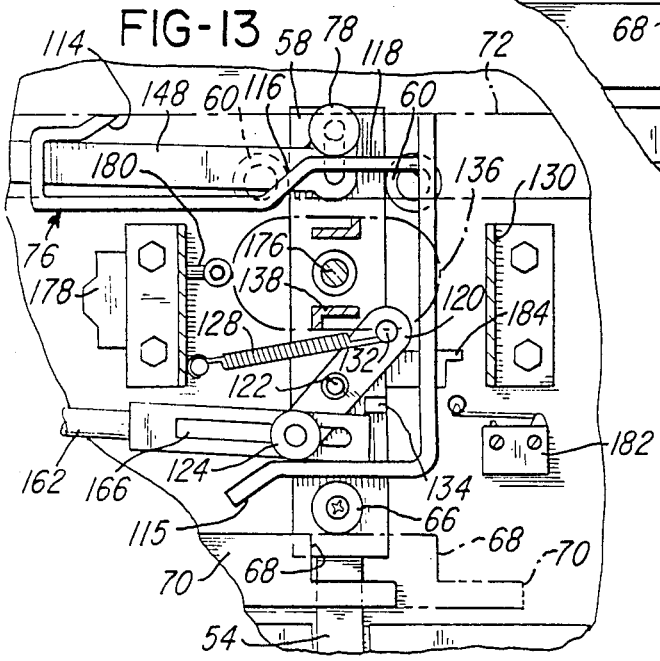
FIG. 13 is a view similar to FIG. 12, illustrating the drop bar in its raised position in response to operation of the "key" option.

When the control lever 84 is rotated (clockwise) from the "Deadlock" mode to the "Release" mode, at detent 112, (FIGS. 1, 13 and 14) the bar 96 is lowered to its lower position, and the master control bar 72 is displaced to the left. As movement of the master control bar 72 approaches its extreme leftward movement, the deadlock provided by link 120 is disabled by a tripper bar 115 (see also FIG. 8), depending from the cam 76. The tripper engages the roller 124 to swing the upper end of the link 120 clear of the overlying lug 138. Further movement of the bar 72 to the left, then causes a ramp 116, on cam 76, to raise the roller 78 and support it on a land 118, as shown in FIG. 13. The drop bar extension 58 and the drop bar 54 are thus raised so that the roller 66 clears the notch 68 on travel bar 70 and the lower end of the drop bar 54 clears the notch 64 in the door guide 52. The door 20 is thus released for movement towards the right and thus released to be opened. Similarly, all other doors in cell block are released. FIGS. 14 and 15 illustrate the the "Release" mode of the master control 80.

It is to be noted that a spring loaded plunger 119 (FIG. 1) engages the left hand end of the trolley 38, urging the door 20 toward an open position. Thus when the drop bar 54 and its extension are raised a distance sufficient to clear the locking means, the door 20 will be displaced to a partially open position. The action of the plunger 119 displaces the travel bar beneath the roller 66 to maintain the drop bar extension 58, as well as the drop bar 54, in a raised, non-locking position. It will also be seen that rubber shock absorbers 121 are provided at opposite ends of the angle bar 44 and are engaged by the trolley at its opposite extremes of movement to minimize noise and damage to the door assembly.

It will again be noted that the full line showings in FIGS. 1, 3 and 5 illustrate the "Individual Cell" mode of the master control 80. In this mode, each individual cell, in the cell block, may be selectively opened by means now to be described. These means comprise a key option and a remote electrical switch option.

It is to be noted that, in the "Individual Cell" mode of the master control 80, the deadlock link 120 is effective to prevent the drop bar extension 58 and the drop bar 54 from being raised. Thus the deadlock mechanism must be disabled to permit opening of the door 20 by either the key option or remote switch option.

Where it is desired to open the door 20, through use of the key option, the following mechanism comes into play. A key lock 140 (FIGS. 1, 3–6 ) is mounted in the pilaster 39, with its key insertion opening 142 disposed on the exterior thereof. The main body of the lock is disposed within the pilaster 39 with an extensible plunger 144 projecting from its lower surface. A bar 146 is secured to the plunger 144 and extends upwardly through the interior of the pilaster to the upper portion of the transom 26, where it is pivotally connected to one end of a lever 148. The lever 148 lies behind the master control bar 72 and is pivotally mounted by stub shaft 150 projecting from the transom 26. The opposite end of the lever has a slot 152 which is received by a groove in the roller 78, FIGS. 3, 5 and 8.

Deadlock release mechanism for the key option comprise a slotted arm 154 projecting from the bar 146 and receiving a pin 156 which is carried on one arm of a bellcrank 158. The bellcrank 158 is journaled relative to the transom 26 by a shaft 160. A link 162 is pivotally connected to the other leg of the bellcrank 158 by a pin 164. An elongated slot 166 is formed in the opposite end of the link 162, which is received by a groove in the compositely formed roller 124, at the lower end of the deadlock link 120.

Opening of the door, using the key option, is accomplished by insertion of a key into the opening 142 and rotating the cylinder to extend the plunger 144 in a downward direction, FIG. 6. The bar 146 is drawn downwardly, as indicated in FIG. 5. The bell crank 158 is rotated in a counter-clockwise direction, first permitting the link 162 to rotate the link 120 out of its deadlock position. At the same time, the slotted end of the lever 148 is pivoted upwardly. The roller 78 is thus displaced upwardly to the position illustrated in FIG. 5, in which the door 20 is opened under the action of the spring loaded plunger 119.

The slotted connection between the lever 148 and the roller 78 and also the slotted connection between the link 162 and the roller 124 are to be noted. These slotted connections permit upward movement of the draw bar extension 58 in the release mode, previously described and also in the remote switch option, now to be described.

Figure 9:
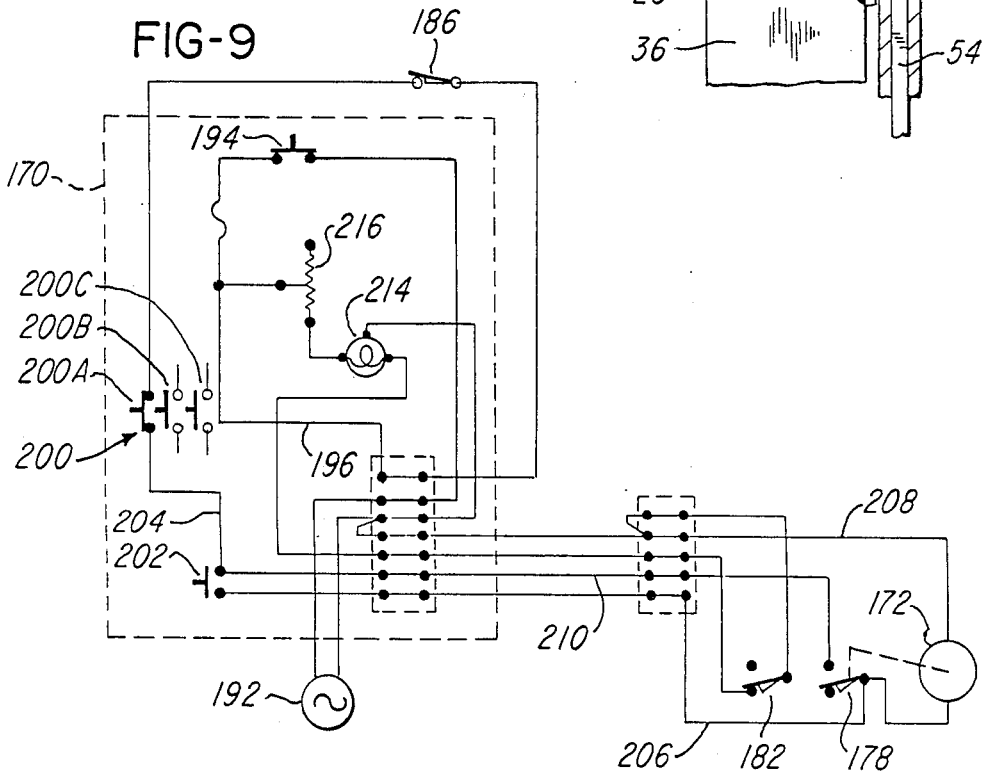
FIG. 9 is a schematic of an electric circuit employed in the operation of the present locking mechanism.

Reference is next made to FIG. 9 for a description of the electrical circuit employed in the remote switch option for opening individual cell doors. The remote actuation components of this circuit are mounted in a control console 170 which may be remotely located, as in the jail keeper's office.

Figure 8:
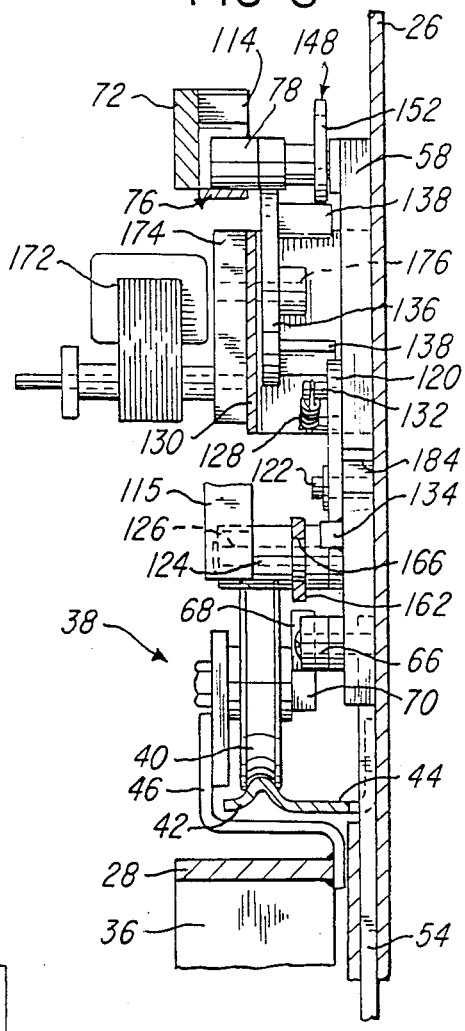
FIG. 8 is a section, on an enlarged scale, taken on line 8—8 in FIG. 3.
Figure 10:
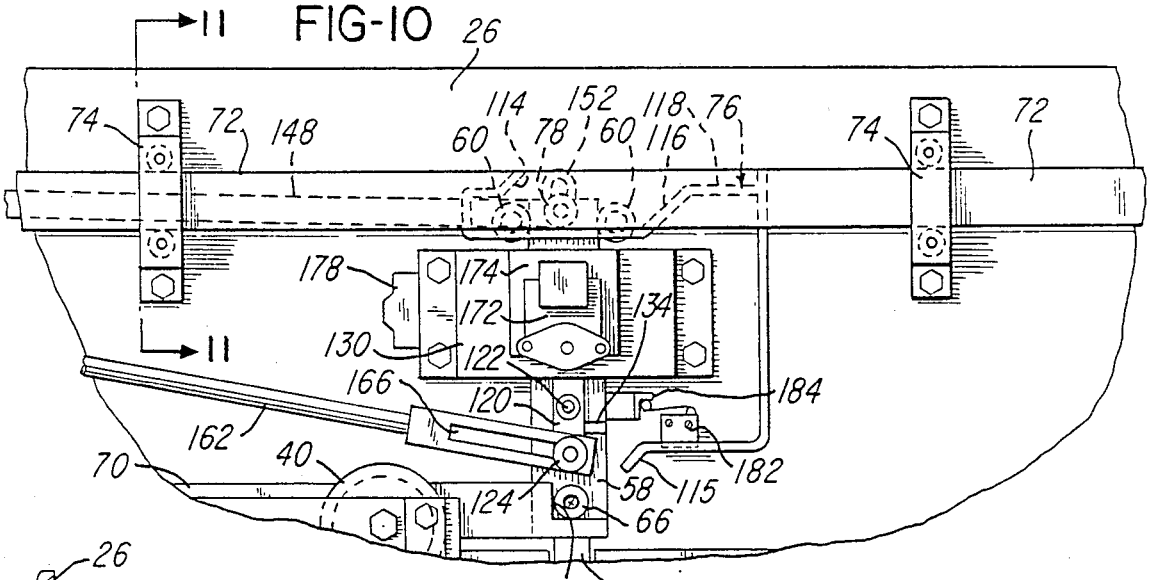
FIG. 10 is a view of control mechanism seen in FIG. 3, illustrating exterior details of the electrical control mechanism.
Figure 11:
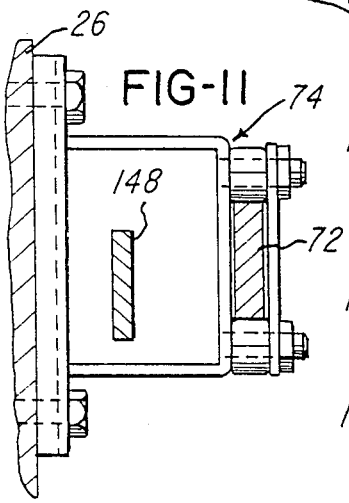
FIG. 11 is a section, on an enlarged scale, taken on line 11—11 in FIG. 10.

The function of the electrical circuit is to actuate an electric motor 172, which is mounted on the bracket 130 in spaced relation from the transom 26 and overlying the upper portion of the drop bar extension 58, FIGS. 8 and 10. The motor 172 drives a reducing gear box 174, having an output shaft 176 to which the cam 136 is secured, FIG. 5. A switch 178 is mounted on the side of the bracket 130 and has a plunger 180 which engages the cam 136 when it is in a deadlock position. Electrically, the contacts of the switch 178 are open in the deadlock position.

A second switch 182 is associated with the drop bar extension 58. This switch is mounted on the transom 26. The switch 182 is engaged by a tab 184 projecting from the drop bar extension 58, to close the contacts thereof when the drop bar 54 is in its lower, door locking position.

A third switch 186 is also associated with the control mechanism and included in the electrical circuit for the remote switch option. This switch is mounted in the master control 80, adjacent the vertical bar 96. The roller plunger 188 rides on the edge of bar 96, maintaining its contacts in an open position. When the master control lever 84 is rotated to the individual cell mode, plunger 188 drops into a notch 190, closing the contacts of switch 186, thus indicating the "Individual Cell" mode of operation to the electrical circuit. Referencing again FIG. 9, the contacts of switches 178, 182 and 186 are shown in the "Individual Cell" mode, with the drop bar extension in its deadlocked position.

The electrical circuit is connected to a power source 192 and powered therefrom through a master switch 194. A fused line 196 provides power for actuating the motor 172.

A selector switch 200 must be actuated to designate the individual cell or cells of the cell block to be opened. Contacts 200 A are closed to designate the cell illustrated in the drawings. Contacts 200 B and 200 C are provided to designate other cells in the cell block, which are similarly provided with the same hardware and condition indicating switches 178, 182 and 186, described in connection with the exemplary cell.

The previously referenced remote switch for opening the door 20 is switch 202, connected in series with the selector switch 200 A. Corresponding remote opening switches are provided in series with the selector switches 200 B, 200 C, etc.

To open the door 20 in the remote switch option, the switch 202 is momentarily closed. Line 204, which is energized through switches 186 and 200 A is connected, by switch 202, to line 206, thus energizing the motor 172, through line 208 to the other side of the power source 192. Initial energization of the motor 172 rotates cam 136 so that the plunger 180 is permitted to extend and close the contacts of the switch 178, thus completing a circuit for energizing the motor 172, through line 210, after the switch 202 is released.

The motor 172 thus is energized until the cam 136 is rotated 180 deg., whereupon the opposite lobe of the cam engages plunger 180, opening the switch 178 and deengergizing the motor 172.

Figure 7:
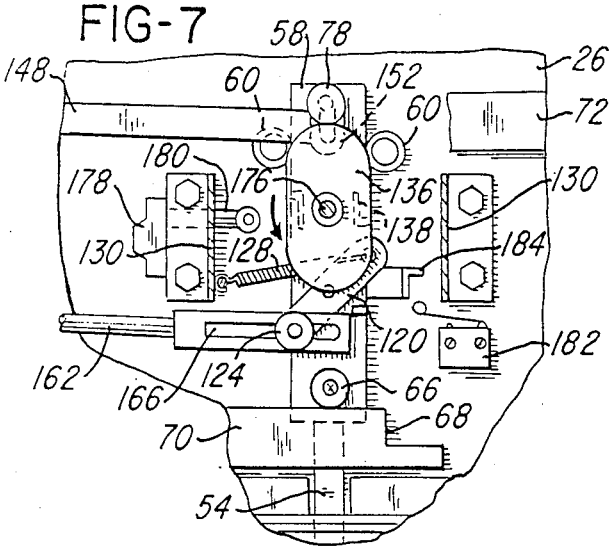
FIG. 7 is a view of a portion of FIG. 3, illustrating unlocking of the door in an "remote switch" option.

Referencing FIGS. 7, 12 and 13, it will be seen that the log 138, overlying the link 120, has a leg 212 which engages the side of the link to rotate it about pin 122, thus disabling the deadlock, during initial rotation of the cam 136. Continued rotation of cam 136 to 90 deg. position, FIG. 7, causes it to raise roller 78, and drop bar extension 58 and the drop bar 54 to a release position. The spring loaded plunger 119 is then effective to partially open the door, FIG. 13, so that the drop bar extension will be held in the release position by the roller 66 riding on the travel bar 70. The cam 136 then completes its 180 deg. rotation, bringing the opposite lug 136 into a deadlock position which will become effective when the door 20 is closed and the drop bar extension dropped to its locking position.

Means are provided at the remote console 170, FIG. 9, to indicate the security condition of each cell door. An indicator light 214 is provided for each door in the cell block. The indicator light is connected across the power source 192 through a voltage divider 216 and the switch 182. When the drop bar extension is in its lower locking position, the contacts of switch 182 are closed and the light 214 is illuminated to indicate that the door is in a secured condition. When the drop bar extension is raised by the means described herein to release the door 20, or for any other reason, the switch 182 is open and the light 214 is not illuminated, thus indicating that the door is not secured.

In summary, the present cell door security system comprises the master control 80 having three control modes. The lever 84 may be positioned in the "Release", "Individual Cell" or "Deadlock" mode positions.

The cell door 20 is guided for lateral sliding movement from a closed position to an open position. The door is locked in the closed position by engagement of the lower end of the drop bar 54 with a notch 62 in a door guide 52 and by the vertical face of a notch 68 formed in a travel bar 70 which engages a roller 66 mounted on the drop bar extension 58, FIG. 3.

The link 120, mounted on drop bar extension 58, in a vertical position, engages the relatively fixed lug 138, to provide a deadlock preventing upward, releasing movement of the drop bar 54 and extension 58.

In the "Deadlock" mode of the master control 80, the master control bar 72 is in an extreme, leftward position, bringing the cam leg 114 into overlying relation with the roller 78 which is mounted on the drop bar extension 58, thus positively preventing upward, releasing movement of the drop bar 54 and the extension 58.

When the lever 84 is swung to the release mode position, the master control bar is displaced to its extreme rightward position, FIG. 13. As it moves to this position the tripper bar 115 disables the deadlock provided by link 120, then ramp 116 of cam 76 lifts the roller 78 to raise the drop bar 54 out of the notch 62 and elevate the roller 66 above the notch 68. Spring loaded plunger then displaces the door to a partially open, or released position, wherein the roller 66 rides on top of the travel bar 70. The master control bar 72 extends to all of the cells of the cell block and, through similar mechanism, simultaneously releases all of the doors in the cell block.

When the lever 84 is position in the "Individual Cell" mode position, the master control bar is in an intermediate position, wherein the roller is clear for upward, releasing movement. In this mode each individual door in the cell block may be independently opened by the key option or the remote switch option. In the key option, a key is employed to displace the plunger 144 of lock 140 downwardly. This actuates link 162 to disable the deadlock, permitting lever 148 to raise roller 78 and elevate the drop bar 54 and extension 58 to a release position.

In the remote switch option, switch 202 is closed (FIG. 9), causing 180 deg. rotation of the cam 136. Leg 212 on lug 138 disables the deadlock and then cam 136 raises the roller 78 to elevate the drop bar 54 and extension 58 to an elevated position, releasing the door 20 for opening movement, under the influence of the spring loaded plunger 119.

Variations in the described, preferred embodiment will occur to those skilled in the art. Accordingly, the spirit and scope of the present inventive concepts are to be derived from the following claims.

Having thus described the invention, what is claimed as novel and desired to be secured by Letters Patent of the United States is:

1. A security system for controlling ingress and egress to and from the individual cells of a cell block, each of which has a door movable to and from a closed position blocking entrance to the cell, wherein each cell is provided with drop bar means movable between a position in which the door is locked in its closed position and a release position in which the door may be displaced from its closed position to an open position, and deadlock means for preventing movement of the drop bar means from its locking position, a master control having a "Deadlock", an "Individual Cell" and a "Release" mode, means for selecting the respective modes of said master control, means, responsive to selection of the "Deadlock" mode, for positively blocking movement of the drop bar means, for all cells, from their locking positions, means, responsive to selection of the "Release" mode, for disabling the deadlock means and positively displacing the drop bar means, of all cells, from their locking positions, means, responsive to selection of the "Individual Cell" mode, for permitting displacement of the drop bar means, of all cells, upon disabling of their respective deadlock means, key option means, associated with each cell and operative upon selection of the "Individual Cell" mode, for disabling the deadlock means and displacing the drop bar means to its release position, to permit opening of a selected cell, and remote switch option means, associated with each cell and operative upon selection of the "Individual Cell" mode, for disabling the deadlock means and displacing the drop bar means to its release position, to permit opening of a selected cell.

2. A security system as in claim 1, including a master control bar extending to each cell of the cell block and displaceable in response to different positions in response to selection of the operative modes of the master control, and wherein the means responsive to selection of the "Deadlock" mode for positively preventing movement of the drop bar means out of their locking positions comprise, in association with each cell, a cam leg carried by the master control bar.

3. A security system as in claim 1, wherein the each key option means include a key operated lock, a link displaceable, in response to key operation of said lock, from an inoperative position to a release position, linkage means connected to said key option link for disabling the deadlock means and displacing the draw bar means to its release position.

4. A security system as in claim 1, wherein the remote switch option means include an electric motor associated with each cell a cam rotated by each motor a remote console having switches in series with each of said motors, a switch connected in series with a power source for said motors, means associated with said master control and operative upon upon selection of the "Individual Cell" mode, for closing the switch connected in series with the power source, whereby, upon selection of the "Individual Cell" mode, the motor of a given cell can be energized by closure of the appropriate switch at the console.

5. A security system as in claim 4, wherein each deadlock means comprise a link pivotally mounted on the drop bar means and aligned with the direction of movement of the drop bar means, and a lug projecting from said motor driven cam and aligned with the deadlock link to prevent movement of the drop bar means out of its locking position, said deadlock link being pivotal out of alignment with said lug to permit movement of the drop bar means to its release position, each remote switch option means for displacing the drop bar means comprise a roller projecting from the drop bar means, which is engaged by the motor driven cam, said cam, when rotated, displacing the drop bar means to its release position, and each deadlock lug has a leg projecting laterally of the deadlock link and engageable therewith to swing it out of alignment with the lug, thus disabling the deadlock means upon rotation of the cam to permit opening of a given cell.

6. A security system as in claim 5, wherein each key option means include a key operated lock, a link displaceable, in response to key operation of said lock, from an inoperative position to a release position, a roller projecting from said deadlock link and linkage means between said key option link and said deadlock link for swinging it out of alignment with the cam lug, and a lever connected at one end to said key option link and at its other end to the cam engaging roller of the drop bar means, for displacing the drop bar means to its release position upon operation of the key option means.

* * * * *